US005950686A

United States Patent [19]

Herrlein et al.

[11] Patent Number: 5,950,686

[45] Date of Patent: Sep. 14, 1999

[54] LOOM WITH A PNEUMATIC SLIDE BEARING FOR SUPPORTING A RIGID ROD OR A FLEXIBLE BAND CARRYING A WEFT INSERTION GRIPPER

[75] Inventors: Wilhelm Herrlein, Neuravensburg; Fritz Rupflin, Lindau, both of Germany

[73] Assignee: Lindauer Dornier Gesellschaft mbH, Lindau, Germany

[21] Appl. No.: 09/040,803

[22] Filed: Mar. 18, 1998

[30] Foreign Application Priority Data

Mar. 20, 1997 [DE] Germany ..... 197 11 594

[51] Int. Cl.[6] ..... D03D 47/27

[52] U.S. Cl. ..... 139/449; 384/99

[58] Field of Search ..... 139/449; 384/99

[56] References Cited

U.S. PATENT DOCUMENTS

| | | | |
|---|---|---|---|
| 3,175,587 | 3/1965 | Gove, Jr. et al. . | |
| 4,936,534 | 6/1990 | Esposito et al. | 139/449 |
| 5,360,278 | 11/1994 | Buckmann | 384/99 |
| 5,727,601 | 3/1998 | Krumm | 139/449 |

FOREIGN PATENT DOCUMENTS

| | | |
|---|---|---|
| 0285001 | 4/1988 | European Pat. Off. . |
| 2001965 | 10/1969 | France . |
| 1535491 | 11/1969 | Germany . |
| 3916591 | 11/1989 | Germany . |

*Primary Examiner*—Andy Falik
*Attorney, Agent, or Firm*—W. F. Fasse; W. G. Fasse

[57] ABSTRACT

A loom is equipped with a pneumatic slide bearing for guiding and supporting a weft insertion gripper carrier, which may be a rigid rapier rod or a flexible band. The pneumatic slide bearing supports and guides the weft gripper carrier in a nearly friction-free manner. The pneumatic slide bearing includes a bearing body (1) that is pivotally mounted on a bolt (3) and that extends along the lengthwise direction of the rapier rod (12) or around the circumferential direction of the flexible band (21). The bearing body (1) has an air channel (5) therein, and has a plurality of transverse holes (6) passing from the air channel out through a side wall. A bearing plate (8) with a plurality of transverse holes (9) therethrough is removably mounted along the side wall of the bearing body (1) so that the transverse holes (9) align with the transverse holes (6). The outlet ends of the transverse holes (9) are enlarged to form respective air pockets (10), which together serve to form a homogenous and stable air cushion between the rapier rod and the bearing plate (8). Removable air nozzles (11) may be screwed into the transverse holes.

33 Claims, 4 Drawing Sheets

LOOM WITH A PNEUMATIC SLIDE BEARING FOR SUPPORTING A RIGID ROD OR A FLEXIBLE BAND CARRYING A WEFT INSERTION GRIPPER

PRIORITY CLAIM

This application is based on and claims the priority under 35 U.S.C. §119 of German Patent Application 197 11 594.2, filed on Mar. 20, 1997.

FIELD OF THE INVENTION

The invention relates to a gripper-type loom including an apparatus for pneumatically guiding and supporting a member carrying the weft insertion gripper, whereby the carrier member may be a rigid rod or a flexible band.

BACKGROUND INFORMATION

It is generally known to mount a weft insertion gripper on the free end of a carrier in the form of a rigid rod or rapier, and to alternately drive the rapier into and out of the loom shed to carry out the weft insertion. For example, German Patent 1,535,491 (Kokkinis) discloses a loom in which the weft insertion is carried out by a gripper system including a rigid rapier rod having a U-shaped cross-section, with a toothed gear rack arranged thereon or therein, and including a drive gear that engages the toothed gear rack so as to alternately drive the rapier rod, and the gripper mounted thereon, into and out of the loom shed.

In order to achieve a precise lengthwise motion of the rapier rod and to prevent the rapier rod from lifting away from the drive gear, it is known to provide one or more guide rollers for supporting and guiding the rapier rod. Generally, such guide rollers are arranged in the area of the drive gear, above or on the opposite side of the rapier rod, so as to press the rapier rod against the drive gear and thus guide and support the rapier rod.

A disadvantage of the known roller bearing arrangements for the rapier rod is that substantial frictional forces are effective between the rollers and the rapier rod, which leads to a relatively high rate of wear on the rollers and the rapier rod. In this context, the roller bearings also cause thermal problems, since the friction between the rollers and the rapier rod generates a substantial amount of heat that must somehow be dissipated. Moreover, the rollers must be accelerated and then again decelerated together with the rapier rod for each movement of the rod into or out of the loom shed, so that the drive arrangement necessarily has a high rotational moment.

It is also known in the art to mount the weft insertion grippers on flexible tapes or bands which are connected to alternately rotating drive wheels for driving the grippers into and out of the loom shed. German Patent 3,916,591 (Esposito et al.), published European Patent Application 0,285,001 (Muller et al.), and U.S. Pat. No. 3,175,587 (Gove, Jr. et al.) each disclose gripper looms using such a system of weft insertion grippers mounted on flexible tapes or bands that are alternately rolled onto and off of drive wheels having a relatively large diameter. These three patent publications also disclose devices for pneumatically guiding the flexible bands.

The arrangement according to European Patent Application 0,285,001 provides a perforated gripper carrying band that engages teeth provided around the perimeter of a drive sprocket or drive wheel. Guidance for the flexible band is provided by one or more toothed guide rollers, and/or by a pneumatic guide element having two rows of pressurized air outlet holes on both sides of the row of drive teeth, as shown and described in connection with FIGS. 12, 13 and 15 of the reference. In the embodiment of FIG. 15, two pneumatic guide elements may be provided at different circumferential areas around the drive wheel, or the two air bearing bodies can be embodied in a one-piece manner so as to extend over the entire range in which the flexible band loops around the drive sprocket.

According to German Patent 3,916,591, the flexible gripper carrying band may either be perforated or non-perforated, and a pneumatic guide element is arranged particularly at the area above the band where the band is no longer in engagement with the drive wheel. The guide element includes a contact plate for guiding the upper surface of the flexible band, whereby holes extend vertically through the contact plate so as to introduce pressurized air into the space between the upper surface of the guide band and the guide plate. The guide element is rigidly mounted by flanges onto a lower guide arranged below the flexible band. The lower plate in turn is rigidly bolted to the machine frame of the loom.

U.S. Pat. No. 3,175,587 (Gove, Jr. et al.) discloses an arrangement of a plurality of arcuately curved hydrostatic air bearings around a portion of a circumference of a tape drive wheel, for guiding and holding the flexible weft insertion tape against the outer rim of the tape drive wheel, especially as the tape is unrolled from the wheel. Each air bearing comprises a single bearing body block having air apertures and air pockets formed therein. Such a construction fails to take into account that some contact wear between the tape and the bearing body is inevitable, and requires the entire bearing body to be replaced if the inner arcuate surface thereof becomes worn. Also, the distribution of air through the air pockets is not as uniform as could be desired. As a further disadvantage, the conventional interconnection of the several air bearings using flexible air lines with numerous T-fittings and joints is prone to leakage and failure.

In high speed looms using a flexible gripper carrying band it is absolutely necessary to provide a positive guidance for the flexible band directly after the point at which it leaves the drive wheel due to the centrifugal forces effective on the flexible band. Namely, centrifugal forces are effective on the flexible band as it is alternately rolled onto and off of the drive wheel, so that the flexible band would lift away from the drive wheel due to the arising forces if a positive guidance is not provided to hold the flexible band against the drive wheel. As discussed above, conventional arrangements of a flexible gripper carrying band use pneumatically operating guide means, as well as mechanical guide rollers, for supporting or guiding the flexible band.

On the other hand, in rapier looms using a substantially rigid rapier rod rather than a flexible band or tape for carrying the weft gripper, it is not necessary to provide such a positive guidance and support for counteracting centrifugal forces, because the rapier rod is not subjected to centrifugal forces since it is only subjected to a linear motion. For this reason, in the prior art it has been considered sufficient to carry out the guidance and support of rigid rapier rods by means of mechanical roller bearings or guide rollers as described above. However, such mechanical guide rollers suffer disadvantages of frictional wear and heating as also discussed above.

SUMMARY OF THE INVENTION

In view of the above, it is an object of the invention to provide an apparatus for guiding and supporting the rapier rod carrying a weft insertion gripper in a loom, whereby this guide and support apparatus suffers lower wear and lower frictional heating than the prior art arrangements, and requires only a low level of maintenance. It is a further object of the invention to provide a particular construction of an improved pneumatic slide bearing for achieving an improved guidance of a flexible gripper carrying band, and reduced complexity and maintenance of the slide bearing. The invention further aims to avoid or overcome the disadvantages of the prior art, and to achieve additional advantages, as set forth herein.

The above objects have been achieved in a gripper loom including a rigid rapier rod for carrying the weft insertion gripper into and out of the loom shed, a drive wheel engaging the rapier rod for alternately driving the rod into and out of the loom shed, a source of pressurized air, and a pneumatic slide bearing that is connected to the source of pressurized air and that is arranged to support and guide the rapier rod at least over a range of the engagement length over which the rapier rod is engaged with the drive wheel. More particularly, the rapier rod includes gear teeth on a gear rack, and the drive wheel includes corresponding gear teeth that engage the teeth of the gear rack over a linear engagement length along the rapier rod. The pneumatic slide bearing supports the rapier rod from the side opposite the drive wheel, i.e. the side opposite the teeth of the gear rack, at least over the range of the engagement length and preferably extending therebeyond in both directions.

The above objects have further been achieved according to the invention in a pneumatic slide bearing having a particular construction. The pneumatic slide bearing especially comprises a bearing body that is preferably pivotally connected to the machine frame of the loom, adjacent the outer surface of the rigid rapier rod opposite the drive wheel. The bearing body has an air channel therein extending substantially along the length thereof, whereby the ends of the air channel are closed, but a side wall of the bearing body facing the outer surface of the rapier rod has first transverse holes passing therethrough communicating with the air channel. A bearing plate is removably connected to the bearing body along the side wall thereof. Second transverse holes are provided through the bearing plate, so as to coincide in number and position with the first transverse holes in the side wall of the bearing body. Each of the second transverse holes in the bearing plate opens outwardly into a respective air pocket that faces the outer surface of the rapier rod.

In a loom using a flexible gripper carrying band or tape that is to be rolled onto and off of a drive wheel for carrying the weft insertion gripper out of and into the loom shed, the invention provides for arranging the special pneumatic slide bearing according to the invention in a circular arc configuration along and around a substantial portion of the circular periphery of the drive wheel.

BRIEF DESCRIPTION OF THE DRAWINGS

In order that the invention may be clearly understood, it will now be described in connection with example embodiments, with reference to the drawings, wherein.

Figure 4:
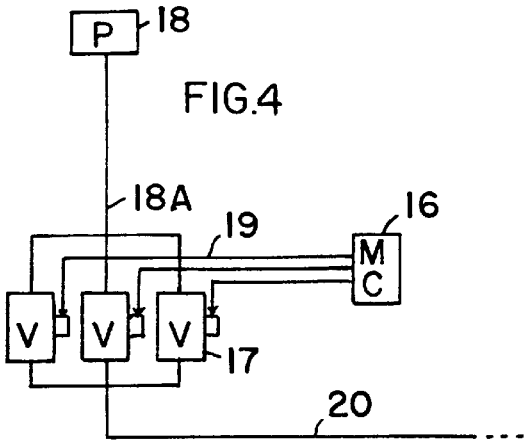
FIG. 4 is a schematic block diagram of a control circuit for controlling the flow of pressurized air to the pneumatic bearing arrangement of FIG. 1.

DETAILED DESCRIPTION OF PREFERRED EXAMPLE EMBODIMENTS AND OF THE BEST MODE OF THE INVENTION

The main point of the invention in connection with a rapier loom is that the rapier rod is guided and supported by a pneumatic slide bearing, which is particularly a slide bearing in which the bearing effect is reinforced or supported by a pressurized air cushion, which is generally referred to as an air bearing herein. The pneumatic slide bearing replaces the conventional support roller arrangement at least over the range or area in which the drive rack of the rapier rod is in engagement with the gear teeth of the drive gear. Thus, the air bearing is preferably arranged in the area of the drive wheel or drive gear and applies a supporting counter force onto the rapier rod from above, i.e. from the side of the rapier rod opposite the drive gear, in order to support and guide the rapier rod and prevent the rapier rod from lifting away from the drive gear. Moreover, the air bearing is also adapted for providing lateral or sideways guidance of the rapier rod, in that the air bearing is so constructed that it also encloses the sides of the rapier rod and thus forms an air cushion between the bearing body and the respective right and left side walls of the rapier rod.

In a first embodiment, the air bearing comprises a pivotal bearing body that is arranged to extend along the lengthwise direction of the rapier rod and that is pivotally or rotatably supported about a pivot pin or bolt. The pivotal arrangement of the bearing body allows the bearing body to be self adapting or adjusting for slight variations in the motion of the rapier rod. Namely, in the event of slight vertical movements of the rapier rod during its alternating back and forth motion in the horizontal direction, the pivotal bearing body will freely tilt or pivot as necessary to provide the proper positive guidance for the rapier rod.

As mentioned above, pressurized air is provided through an air channel extending along the bearing body, and exits the air channel through transverse holes facing toward the rapier rod. The actual bearing is provided by an elongate bearing plate that has a length substantially corresponding to that of the bearing body, and that is removably connected to the bearing body such that the transverse holes in the bearing plate coincide with the transverse holes in the bearing body. Thus, the pressurized air is emitted through the transverse holes in the bearing plate toward the rapier rod. The outlet sides of the transverse holes in the bearing plate, on the side thereof facing the rapier rod, are expanded to open into so called air pockets, which each have a larger cross-sectional area than that of the inlet end of each of the transverse holes. By means of the enlarged air pockets, a homogenous and stable air cushion is formed between the bearing plate and the rapier rod.

With this pneumatic bearing support, the rapier rod is guided and held in engagement with the drive gear in an almost friction free manner. A further advantageous effect is that the flow of pressurized air serves to cool the air bearing itself as well the rapier rod over the range of its engagement with the drive gear.

For the simplest operation of the loom, the air bearing may be continuously provided with pressurized air at a constant pressure. However, a more advantageous and only slightly more complicated embodiment involves providing pressurized air to the air bearing in an intermittent controlled manner carried out by the loom control, such that an air cushion is developed in the air bearing only during the phases of movement of the rapier rod. Thereby the total consumption of pressurized air may be reduced. In order to achieve this, pressure valves are controlled by the loom control unit, whereby the air pressure and the air quantity may be controlled individually for each phase of the motion of the rapier rods, to achieve the most precisely tailored pneumatic guidance as required.

In a further embodiment of the air bearing, the transverse holes in the bearing body are respectively provided with internal threadings, into which are screwed so-called screw-in nozzles that are removable and replaceable. The use of such screw in nozzles is in addition to the provision of the air pockets in the bearing plate as described above. In this arrangement, the air pockets in the bearing plate are somewhat deeper, so that the screw-in nozzles can be inserted through the air pockets and screwed into the respective threading provided in the transverse holes in the bearing body. Each screw-in nozzle has at least one air jet channel passing therethrough and communicating with the air channel in the bearing body. In this manner, the bearing body and the bearing plate are connected to each other both mechanically as well as pneumatically for air communication.

The use of such replaceable screw-in nozzles instead of transverse holes acting as air nozzles in the bearing plate achieves the advantage that cleaning and maintenance of the air nozzles is simplified, because a plugged or dirty screw-in nozzle may quickly and easily be removed and replaced by a properly functioning screw-in nozzle, without having to carry out a cleaning or maintenance procedure directly on the bearing body while the loom is shut down. Moreover, the use of such screw-in nozzles achieves a very secure and air tight connection between the bearing body and the bearing plate, since each screw-in nozzle simultaneously functions as a connection element.

The air bearing according to the invention also provides a secondary or safety bearing support by a mechanical slide bearing formed by the bearing plate. In other words, the bearing plate ensures that the rapier rod is supported with sufficiently low friction and without damaging the rapier rod or the bearing, if the supply of pressurized air fails or drops in pressure, or in the event of intermittent physical contact between the rapier rod and the bearing plate caused by extraordinary shocks or deflections of the rapier rod. For this purpose, the material of the bearing member, and especially the material of the bearing plate, is selected in combination with the material of the rapier rod to provide good sliding and emergency operating characteristics, for example in the event of an air pressure reduction or a failure, as well as a sufficient wear resistance and run-in and embedding properties. In this connection, the rapier rod preferably is made of a carbon fiber reinforced composite material, and in combination therewith the bearing plate preferably comprises copper, such as copper metal or a copper alloy, among other suitable materials. The bearing plate may alternatively be made of a low friction plastic material. The bearing body itself preferably is made of a light metal or light metal alloy. For example the bearing body may comprise aluminum, such as aluminum metal or an aluminum alloy. Since the bearing plate is removably connected to the bearing body, maintenance or repair of the bearing arrangement once the bearing plate has become worn, simply requires replacement of the worn bearing plate with a new or refurbished bearing plate. The bearing body itself is protected from wear or damage.

Embodiments of the invention will now be described particularly with reference to the drawings.

FIGS. 1 to 5 show a first embodiment of a pneumatic slide bearing according to the invention. The rapier rod 12 may itself be a substantially conventional rapier rod. In the present example the rod 12 is a U-shaped sectional profile including two flanges interconnected by a spine web, with a toothed gear rack integrated therein between the flanges. At its free or forward end, the rapier rod 12 carries a weft gripper 14. A toothed drive gear or drive wheel 13 engages the toothed gear rack of the rapier rod 12 so as to drive the rapier rod 12 linearly back and forth as the drive gear 13 rotates alternately back and forth as shown by arrow 27.

In order to slidingly support and guide the rapier rod 12, and hold the rapier rod 12 in proper engagement against the drive wheel 13, a pneumatic slide bearing is arranged above the upper surface 12A of the rapier rod 12. The pneumatic slide bearing comprises a pivotal bearing body 1, which is pivotally supported on a mounting pin or bolt 3 so as to be tiltable or pivotal about the center axis 3A of the mounting bolt 3. For this purpose, the mounting bolt 3 is received in a bushing 4 provided in the bearing body 1, and is rigidly secured to a component of the frame structure of the loom W. More specifically, the bushing 4 is provided in an upwardly protruding lug 1A of the bearing body 1 with its axis extending perpendicularly to the length of the body 1, and the bearing bolt 3 is secured to the housing 15 of the drive train for the drive wheel 13. The mounting bolt may be arranged in such a manner as to be vertically and horizontally adjustable for placing the bearing body 1 into the proper position relative to the rapier rod 12 and the drive wheel 13. The pivotal support of the bearing body 1 allows the bearing body 1 to automatically compensate or adjust to any vertical deviations of the motion of the rapier rod 12.

The bearing body 1 encloses therein an air channel 5 that extends substantially along the length L of the bearing body 1 and that is closed at its two ends. The air channel 5 communicates with a pressurized air connection 2 and with a plurality of first transverse holes 6 extending through a side wall 1' of the bearing body 1 facing toward the rapier rod 12. A bearing plate 8 has a length and width substantially corresponding to the dimensions of the bearing body 1, and is connected to the bearing body 1 along the side wall 1' at the outlet end of the first transverse holes 6. The bearing plate 8 has a plurality of second transverse holes 9 therein, of which the number and position correspond to those of the first transverse holes 6 in the side wall 1' of the bearing body 1. The bearing plate 8 is rigidly but removably connected to the bearing body 1, for example by connection screws 7, in such a position that the second transverse holes 9 in the bearing plate 8 respectively line up with the first transverse holes 6 in the bearing body 1.

Figure 2:
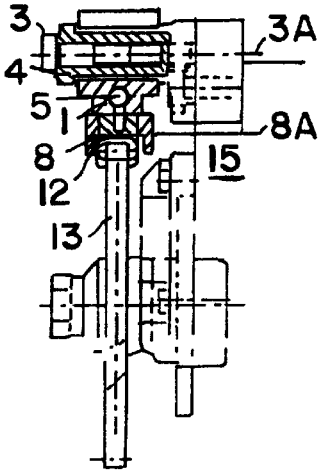
FIG. 2 is a schematic sectional view along the line II—II in FIG. 1.

With this arrangement, pressurized air is provided through the air connection 2 into the air channel 5, and is then emitted through the transverse holes 6 and 9 to flow out of the bearing plate 8 toward the rapier rod 12. The bearing plate 8 is arranged sufficiently close to the rapier rod 12 so that the emitted pressurized air forms an air film or air cushion between the bottom surface of the bearing plate 8 and the top surface 12A of the rapier rod 12. Furthermore, side plates 8A may extend from the bearing plate 8 or the bearing body 1 downwardly along the side edges of the rapier rod 12, as shown in FIG. 2, so that the air film or air cushion extends down along the sides of the rapier rod 12 so as to provide lateral guidance as well.

Figure 3:
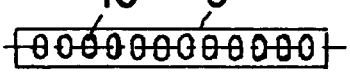
FIG. 3 is a schematic bottom plan view of a bearing plate used in the bearing arrangement of FIG. 1.
Figure 5:
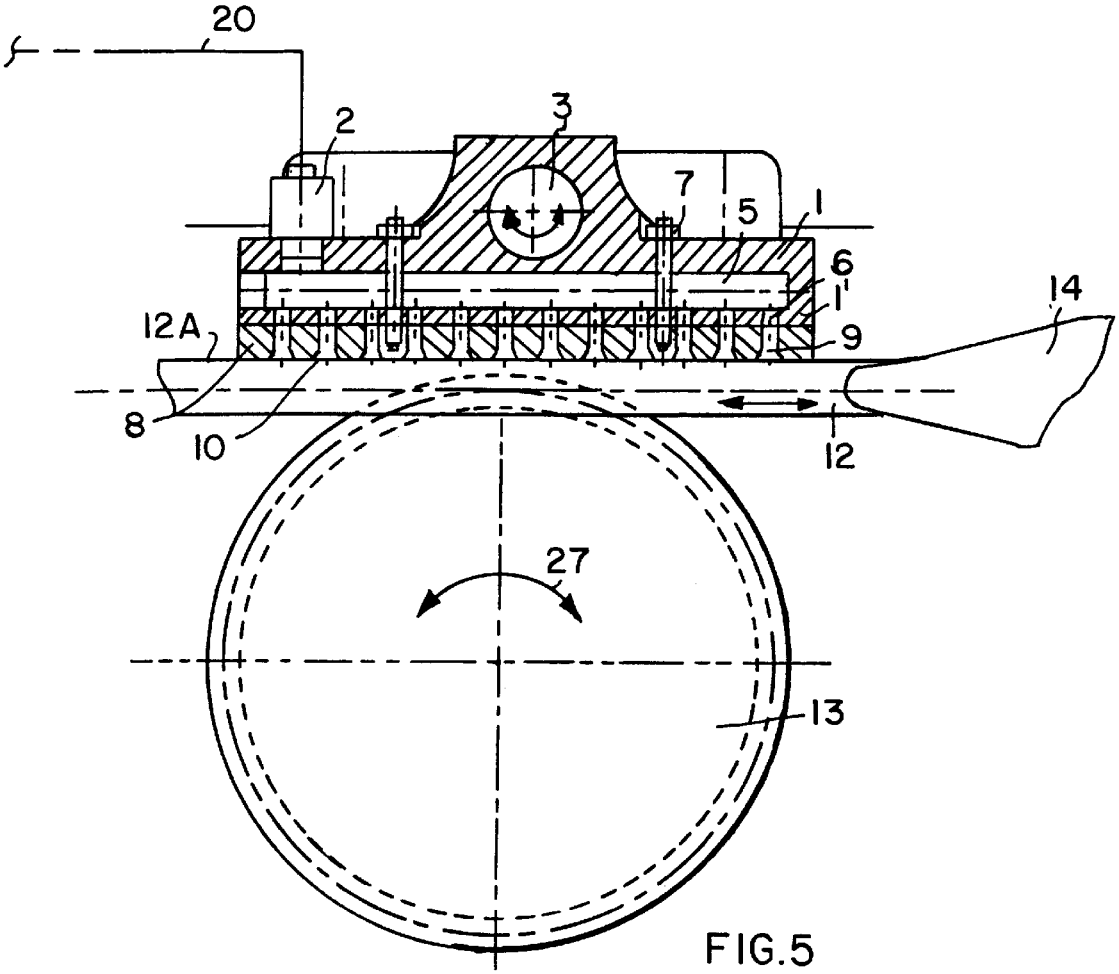
FIG. 5 is an enlarged detail view corresponding to FIG. 1.

In order to achieve a particularly homogenous and stable air cushion, the outlet end of each transverse hole 9 in the bearing plate 8 is expanded or enlarged to form a respective air pocket 10, as shown especially in the bottom view of FIG. 3. Particularly, each air pocket 10 is a recess in the bottom surface of the bearing plate 8, respectively communicating with a transverse hole 9, and having an enlarged cross-sectional area, for example in the shape of an oval outlet opening. The cross-sectional size of the air pockets may be enlarged (relative to the size of the transverse holes) in only one direction or in both directions. By means of these air pockets 10, the air cushion is formed uniformly over the entire upper width of the upper surface 12A of the rapier rod 12, as intended.

As shown schematically in FIG. 4, the supply of pressurized air through the air line 20 to the air connection 2 on the bearing body 1 can be provided from a pressurized air source (P) 18 through a bank of valves (V) 17 that are each controlled by the loom control (MC) 16. For simplicity and effectiveness, three valves 17 may be simple on-off air valves, preferably each having a different through-flow rate, whereby the valves may be connected to the single pressurized air source 18 by an air line 18A, and to the loom control 16 by respective electrical control lines 19. The valves may alternatively each be the same. The quantity of pressurized air as well as the time point at which the air is delivered to the bearing body 1 can easily be controlled depending on which one or how many and which ones, if any, of the valves 17 are opened at any particular time. An even simpler arrangement for providing pressurized air to the bearing body 1 avoids a complicated control arrangement by simply providing pressurized air at a constant pressure and a constant flow rate to the air bearing, continuously during operation of the loom.

Figure 1:
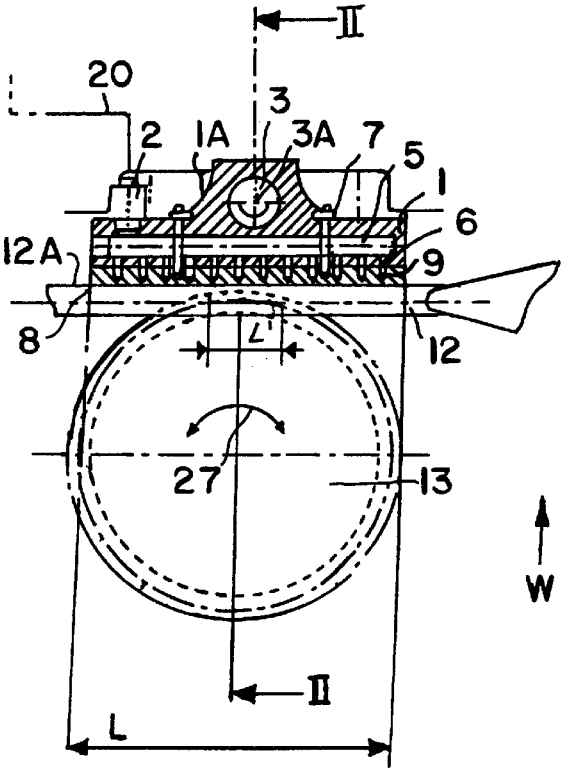
FIG. 1 is a schematic sectional view of a first embodiment of a pneumatic slide bearing arrangement according to the invention.

As shown especially in FIG. 1, the length L of the bearing body 1 over which it supports and guides the rapier rod l encompasses and is preferably substantially greater than the length of the engagement zone L' over which the rapier rod 12 is engaged with the drive wheel 13. Preferably, the length L of the bearing body 1 is at least a three-fold or four-fold multiple of the engagement zone length L' and is arranged to extend along the rapier rod 12 in both directions or on both sides of the engagement zone length L'. Most preferably, the length L of the bearing body 1 is arranged substantially symmetrically about the engagement zone length L'.

Figure 7:
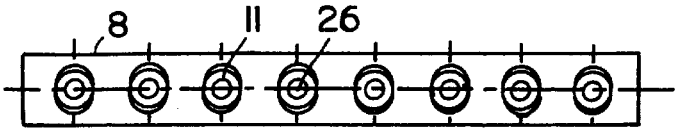
FIG. 7 is a bottom plan view of the bearing plate used in the bearing arrangement of FIG. 6.
Figure 6:
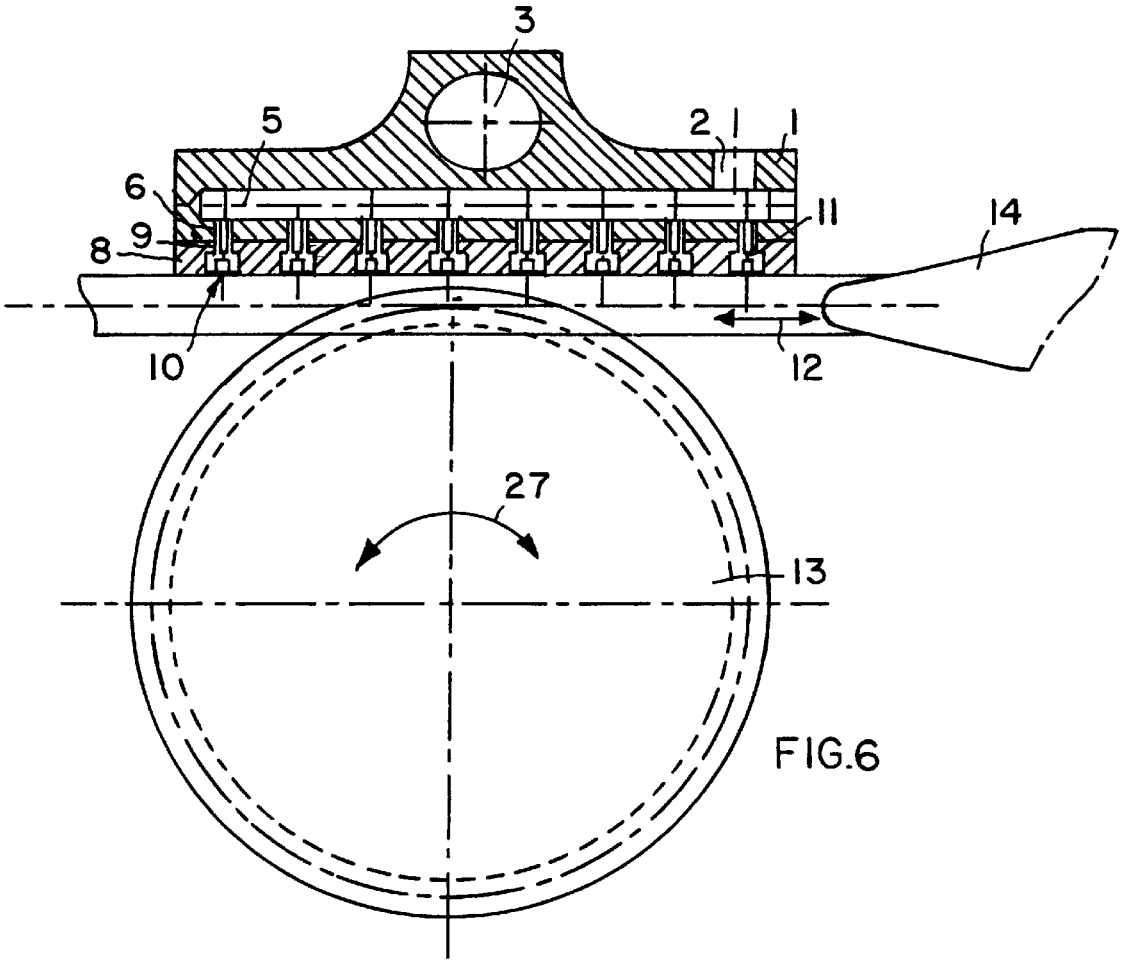
FIG. 6 is an enlarged sectional view similar to that of FIG. 5 but showing a second embodiment of the bearing arrangement according to the invention.

FIGS. 6 and 7 show a further embodiment of the pneumatic slide bearing, which is a variation of the embodiment described above. Most of the essential elements and functions of the embodiment described above apply identically in the present case, whereby the corresponding elements bear the same reference numbers and will not be described again. The major difference in this embodiment relative to the first embodiment is in the construction of the transverse holes 6 provided in the bearing body 1 and the transverse holes 9 provided in the bearing plate 8.

Specifically, the transverse holes 6 in the bearing body 1 are each provided with an internal threading, into which a respective screw-in nozzle 11 is screwed. Each screw-in nozzle 11 has at least one air flow or air jet channel 26 extending axially therethrough. The screw-in nozzles in this case take over the function of communicating the air flow from the air channel 5 through the bearing plate 8, and also the function of connecting the bearing plate 8 to the bearing body 1. In order to receive the head of each screw-in nozzle 11 recessed in the bearing plate 8, the air pockets 10 formed in the bearing plate 8 are somewhat deeper than in the first embodiment. More particularly, the heads of the screw-in nozzles 11 are completely received within the transverse holes 9, while the air pockets 10 are still provided at the surface of the bearing plate 8 on the outlet sides of the screw-in nozzles 11 in order to carry out the above described function of the air pockets. The use of the screw-in nozzles 11 achieves a simplified cleaning and maintenance of the air bearing in comparison to the first embodiment, since plugged or dirty screw-in nozzles may simply be exchanged or replaced without having to remove and service the entire air bearing.

Figure 8:
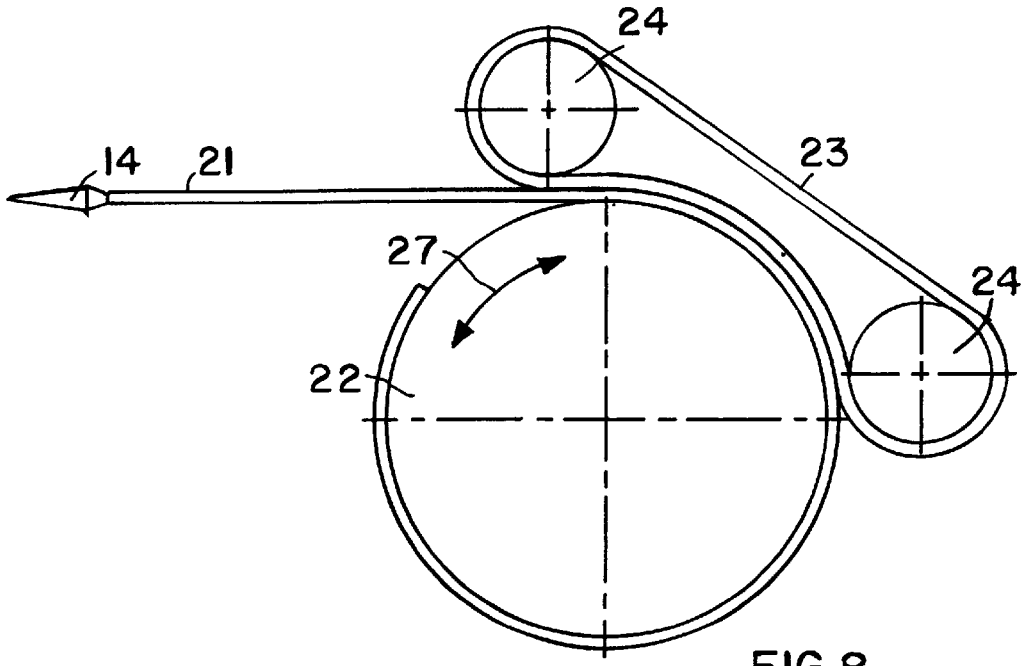
FIG.8 PRIOR ART
FIG. 8 is a schematic side view of a drive and support arrangement for a flexible band carrying a weft insertion gripper according to the prior art.

The above described embodiments relate to the support and guidance of rigid rapier rods. However, the inventive air bearing arrangement is also applicable to looms using a flexible band for carrying the weft insertion gripper. FIG. 8 schematically shows a conventional arrangement of a flexible band 21 that is driven by an alternately rotating drive wheel 22 in the directions of the double headed arrow 27. In the retracted state, the flexible band 21 is looped around nearly the entire circumference of the drive wheel 22, while in the extended or weft insertion position, the flexible band 21 is rolled off of the drive wheel 22. A known manner of supporting the flexible band 21 uses a combination of rollers 24 and a guide band 23, which supports and guides the flexible band 21 over a relatively large angular range of the drive wheel 22 and prevents the flexible band 21 from lifting away from the drive wheel 22.

Figure 9:
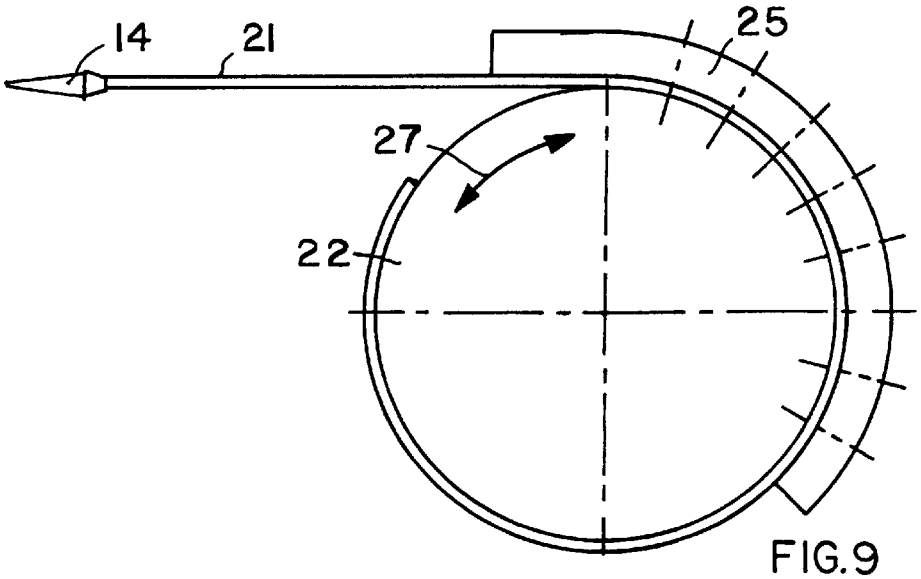
FIG. 9 is a schematic side view of a drive and support arrangement for a flexible gripper carrying band according to the invention.

In comparison to FIG. 8, FIG. 9 shows an arrangement of an air bearing 25 according to the invention, for supporting the flexible band 21 on the drive wheel 22. The air bearing 25 is arranged to extend along and follow the circumference of the drive wheel 22 over a relatively large angular range, for example at least 90° and preferably at least about 135°, beginning with a portion having a linear configuration at a point along the flexible band 21 just before its engagement with the drive wheel 22. More specifically, the air bearing 25 is arranged to receive and guide the flexible band 21 between the drive wheel 22 and the air bearing 25, whereby the configuration of the air bearing 25 follows the contour of the flexible band 21 wrapped around the drive wheel 22. The particular structure and function of the air bearing 25 corresponds to that described above in connection with the previous embodiments, while having an arcuate shape. By using the present air bearing, the large frictional losses and the necessary rotational drive moment that are typically associated with the use of flexible gripper carrying bands can be considerably reduced.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The term "substantially" used herein is intended to cover a range of variations resulting from typical production tolerances.

What is claimed is:

1. In a rapier loom having a loom shed, a weft insertion gripper carried on a rigid rapier rod, and a drive wheel that engages said rapier rod and that is adapted to rotate alternately in opposite directions so as to drive said rapier rod carrying said gripper back and forth into and out of said loom shed, an improved apparatus for guiding and supporting said rapier rod, comprising an elongate pneumatic slide bearing arranged to guide and support an outer surface of said rapier rod facing away from said drive wheel at least along an engagement zone in which said rapier rod is in engagement with said drive wheel, and a source of pressurized fluid medium connected to said pneumatic slide bearing.

2. The improved apparatus in the rapier loom according to claim 1, wherein said loom further includes an electronic loom control, wherein said apparatus further comprises a valve assembly that is interposed between said source of pressurized fluid medium and said pneumatic slide bearing and that is connected by at least one electrical conductor to said electronic loom control, and wherein said electronic loom control is adapted to be programmed to selectively transmit control signals through said at least one electrical conductor to said valve assembly for controlling a time sequence and a flow rate of said pressurized fluid medium flowing through said valve assembly to said pneumatic slide bearing.

3. The improved apparatus in the rapier loom according to claim 2, wherein said electronic loom control and said valve assembly are further adapted to together control a supply pressure of said pressurized fluid medium flowing to said pneumatic slide bearing.

4. The improved apparatus in the rapier loom according to claim 2, wherein said valve assembly comprises three on-off valves connected in parallel with one another.

5. The improved apparatus in the rapier loom according to claim 4, wherein said three on-off valves each have a respective different maximum flow rate therethrough.

6. The improved apparatus in the rapier loom according to claim 1, wherein said source of pressurized fluid medium is connected to said pneumatic slide bearing in such a manner that said pressurized fluid medium is provided to said pneumatic slide bearing continuously at a constant flow rate and a constant pressure.

7. The improved apparatus in the rapier loom according to claim 1, wherein said rapier rod has a substantially U-shaped sectional shape including two shank flanges interconnected by a spine web, and has a toothed gear rack provided along said spine web between said two shank flanges, wherein said drive wheel includes drive gear teeth on a periphery thereof, and wherein said drive wheel reaches into said U-shaped sectional shape of said rapier rod such that said gear teeth engage and mesh with said toothed gear rack of said rapier rod.

8. The improved apparatus in the rapier loom according to claim 1, wherein said pneumatic slide bearing has a bearing length along a lengthwise direction of said rapier rod that is at least twice an engagement length of said engagement zone in which said rapier rod is in engagement with said drive wheel.

9. The improved apparatus in the rapier loom according to claim 8, wherein said bearing length is at least three times said engagement length.

10. The improved apparatus in the rapier loom according to claim 8, wherein said bearing length is at least four times said engagement length.

11. The improved apparatus in the rapier loom according to claim 8, wherein said pneumatic slide bearing is arranged such that said bearing length is symmetrically centered relative to said engagement length.

12. The improved apparatus in the rapier loom according to claim 1, wherein said loom further includes a machine frame, and wherein said pneumatic slide bearing is mounted pivotally relative to said machine frame.

13. The improved apparatus in the rapier loom according to claim 1, wherein said pneumatic slide bearing comprises a bearing body with an air channel therein bounded by a side wall of said bearing body facing toward said rapier rod, wherein a plurality of first transverse holes communicating with said air channel pass outwardly through said side wall of said bearing body, and wherein said pneumatic slide bearing further comprises a bearing plate that is removably mounted on said bearing body along said side wall so as to be adjacent said outer surface of said rapier rod and that has a plurality of second transverse holes passing therethrough respectively in fluid flow communication with said first transverse holes.

14. The improved apparatus in the rapier loom according to claim 13, wherein said pneumatic slide bearing further comprises two side plates that protrude beyond said bearing plate along side edges of said rapier rod, such that said pressurized fluid medium is emitted from said second transverse holes to form an air cushion between said bearing plate and said outer surface of said rapier rod and respectively between said side plates and said side edges of said rapier rod.

15. A method of using the improved apparatus in the rapier loom according to claim 1, comprising varying at least one of a fluid flow rate and a fluid pressure of said pressurized fluid medium over time, responsively to a control program, during operation of said loom.

16. A method of using the improved apparatus in the rapier loom according to claim 1, comprising supplying said pressurized fluid medium to said pneumatic slide bearing at a constant flow rate and a constant pressure continuously during operation of said loom.

17. In a loom having a loom shed, a weft insertion gripper carried on a flexible band, and a drive wheel that engages said flexible band and that is adapted to rotate alternately in opposite directions so as to unroll said flexible band from said drive wheel and roll said flexible band onto said drive wheel and thereby to drive said flexible band carrying said gripper back and forth into and out of said loom shed, an improved apparatus for guiding and supporting said flexible band, comprising an arcuately shaped pneumatic slide bearing comprising a bearing body that has an air channel extending longitudinally therein and that includes an arcuate side wall bounding said air channel on a side facing toward said flexible band, and an arcuate bearing plate that is removably connected to said bearing body and that extends along said side wall of said bearing body, wherein said side wall has a plurality of first transverse holes therein communicating with said air channel and passing outwardly through said side wall, wherein said bearing plate has a plurality of second transverse holes therein respectively communicating with said first transverse holes and passing outwardly through said bearing plate, and wherein said bearing plate further has a plurality of air pockets therein respectively located at and communicating with respective outer ends of said second transverse holes at an outer surface of said bearing plate facing toward said flexible band.

18. A pneumatic slide bearing for guiding and supporting a carrier member for carrying a weft insertion gripper in a loom, comprising a bearing body that has an air channel extending longitudinally therein alone a longitudinal extension direction of said pneumatic slide bearing and that includes a side wall bounding said air channel on a side adapted to be arranged facing toward the carrier member of the loom, and a bearing plate that is removably connected to said bearing body and that extends along said side wall of said bearing body, wherein said side wall has a plurality of first transverse holes therein communicating with said air channel and passing outwardly through said side wall, wherein said bearing plate has a plurality of second transverse holes therein respectively communicating with said first transverse holes and passing outwardly through said bearing plate, and wherein said bearing plate further has a plurality of air pockets therein respectively located at and communicating with respective outer ends of said second transverse holes at an outer surface of said bearing plate facing away from said bearing body and adapted to face the carrier member of the loom.

19. The pneumatic slide bearing according to claim 18, wherein said bearing body further comprises a pressurized air connection port that communicates with said air channel and that is adapted to be connected to a source of pressurized air.

20. The pneumatic slide bearing according to claim 18, wherein said bearing body has a mounting hole passing therethrough substantially perpendicular to and offset from said air channel, and said bearing body further comprises a bearing bushing arranged in said mounting hole, whereby said bearing body is adapted to be mounted on the loom by a mounting bolt that passes through said bushing and is connected to the loom so that said bearing body is tiltably pivotal about the mounting bolt relative to the loom.

21. The pneumatic slide bearing according to claim 18, wherein said air pockets are adapted and arranged to emit pressurized air from said air channel toward the carrier member of the loom so as to form an air cushion between said bearing plate and the carrier member.

22. The pneumatic slide bearing according to claim 21, further comprising two side plates that protrude substantially perpendicularly beyond said outer surface of said bearing plate and that are arranged and spaced apart from each other so as to be adapted to receive the carrier member of the loom therebetween, such that said air cushion is adapted to be formed between a major surface of the carrier member and said outer surface of said bearing plate and respectively between side edges of the carrier member and said side plates.

23. The pneumatic slide bearing according to claim 18, wherein said air pockets are recesses in said outer surface of said bearing plate, and said air pockets each respectively have an enlarged cross-sectional area relative to a respective cross-sectional area of said second transverse holes.

24. The pneumatic slide bearing according to claim 23, wherein said air pockets respectively have an oval shape with a major dimension extending perpendicularly to said longitudinal extension direction of said pneumatic slide bearing.

25. The pneumatic slide bearing according to claim 23, wherein said air channel is a single cylindrical bored hole in said bearing body, and wherein said first transverse holes and said second transverse holes and said air pockets are respectively arranged as a single row along said longitudinal extension direction of said pneumatic slide bearing.

26. The pneumatic slide bearing according to claim 18, wherein said first transverse holes respectively have internal threadings therein, and said pneumatic slide bearing further comprises a plurality of air nozzles respectively having external threadings that are respectively screwed into said internal threadings.

27. The pneumatic slide bearing according to claim 26, wherein each one of said air nozzles has a single air jet channel therein.

28. The pneumatic slide bearing according to claim 18, wherein said bearing plate comprises copper, and wherein said bearing body comprises aluminum.

29. The pneumatic slide bearing according to claim 18, having a longitudinal extension length that is adapted to be greater than an engagement length over which the carrier member of the loom is in engagement with a carrier member drive wheel of the loom.

30. The pneumatic slide bearing according to claim 18, wherein said side wall of said bearing body and said bearing plate each respectively have a planar configuration adapted to extend along the carrier member, which is a linear rigid rapier rod.

31. The pneumatic slide bearing according to claim 18, wherein said side wall of said bearing body and said bearing plate each respectively comprise at least a first portion having an arcuate cylindrically curved configuration adapted to extend along the carrier member, which is a flexible band wrapped around at least a portion of a circumference of a drive wheel of the loom.

32. The pneumatic slide bearing according to claim 31, wherein said arcuate cylindrically curved configuration spans an arc of about 135°.

33. The pneumatic slide bearing according to claim 31, wherein said side wall of said bearing body and said bearing plate each respectively further comprise a second portion having a linear configuration that extends from said first portion tangent to said curved configuration of said first portion.

* * * * *

UNITED STATES PATENT AND TRADEMARK OFFICE
CERTIFICATE OF CORRECTION

PATENT NO. : 5,950,686

DATED : Sep. 14, 1999

INVENTOR(S) : Herrlein et al.

It is certified that error appears in the above-identified patent and that said Letters Patent is hereby corrected as shown below:

Title Page: under "References Cited":
line 2, before "6/1990", replace "5,936,534", by --5,936,354--;
line 3, before "11/1994", replace "5,360,278", by --5,360,273--.

Col. 1,
line 56: before "et al.)", replace "(Muller", by --(Müller--;

Col. 10,
line 67: after "therein", replace "alone", by --along--.

Signed and Sealed this

Fourteenth Day of March, 2000

*Attest:*

Q. TODD DICKINSON

*Attesting Officer*

*Commissioner of Patents and Trademarks*